US007909174B1

(12) United States Patent
Yu

(10) Patent No.: US 7,909,174 B1
(45) Date of Patent: Mar. 22, 2011

(54) DEWATERING STRUCTURE FOR DEWATERING A WATER-CONTAINED OBJECT

(76) Inventor: Tsung Mou Yu, Taipei (TW)

( * ) Notice: Subject to any disclaimer, the term of this patent is extended or adjusted under 35 U.S.C. 154(b) by 62 days.

(21) Appl. No.: 12/548,439

(22) Filed: Aug. 27, 2009

(51) Int. Cl.
*A47L 13/58* (2006.01)

(52) U.S. Cl. ..... 210/403; 210/360.1; 210/380.1; 210/380.2; 34/58; 15/263

(58) Field of Classification Search ..... 210/403, 210/360.1, 380.2, 380.1; 34/58; 15/263
See application file for complete search history.

(56) References Cited

U.S. PATENT DOCUMENTS

| | | | | |
|---|---|---|---|---|
| 4,060,483 | A * | 11/1977 | Barzuza | 210/741 |
| 5,569,383 | A * | 10/1996 | Vander Ark et al. | 210/408 |
| 7,743,528 | B2 * | 6/2010 | Lin | 34/58 |
| 2002/0112311 | A1 * | 8/2002 | Ho | 15/263 |
| 2009/0151399 | A1 * | 6/2009 | Lin | 68/23 R |
| 2010/0077561 | A1 * | 4/2010 | Yu | 15/260 |
| 2010/0078376 | A1 * | 4/2010 | Yu | 210/236 |
| 2010/0122953 | A1 * | 5/2010 | Yu | 210/405 |
| 2010/0180460 | A1 * | 7/2010 | Tang | 34/58 |
| 2010/0218335 | A1 * | 9/2010 | Lin | 15/260 |
| 2010/0242205 | A1 * | 9/2010 | Chen | 15/263 |
| 2010/0306952 | A1 * | 12/2010 | Chu | 15/260 |

FOREIGN PATENT DOCUMENTS

| | | |
|---|---|---|
| TW | M338634 | 8/2008 |

* cited by examiner

*Primary Examiner* — Thomas M Lithgow

(57) ABSTRACT

A dewatering structure includes a receptacle body, a dewatering unit and an operation apparatus. The receptacle body includes a receptacle tub and an assembling space, in which the receptacle tub and the assembling space are independent from each other. The operation apparatus includes an operation unit and a base. The operation unit includes an active pedal and a driven pedal, which are pivotally coupled to the base and are intersected with each other. The driven pedal includes a free end slidably coupled with a driving block having a threaded through hole. The threaded through hole is provided for connection with a threaded rod sheathed in a spring member. When the active pedal and the driven pedal are repetitively pressed each other and then released, the dewatering unit is driven to rotate, thus producing a centrifugal force for removing the water from the water-contained object.

4 Claims, 5 Drawing Sheets

DEWATERING STRUCTURE FOR DEWATERING A WATER-CONTAINED OBJECT

BACKGROUND OF THE INVENTION

1. Field of the Invention

The present invention relates generally to a dewatering structure, and more particularly, to an electricity-free dewatering structure adapted for dewatering a water-contained object by applying a centrifugal force produced by a rotation.

2. The Prior Arts

Mopping floor is a routine job in daily life. In general, a wet cloth sheet is often used to clean the floor. More often, different kinds of mops are used to mop the floor. However, mop cloth used for cleaning the floor has to be repetitively flushed by water for removing dusts or dirt from the mop cloth, and the water contained in the mop cloth has to be reduced to a suitable degree. Typically, the water contained in the cloth sheet has to be removed by wringing with hands or by a centrifugal drier. However, a mop includes a mop cloth and a rod connected with each other. Thus, the mop cannot be put into a centrifugal drier for removing the water therefrom, and it is also inconvenient and laborious to wring the mop cloth. Moreover, when wringing the cloth sheet or the mop cloth with hands to remove the water, one may be in the risk of having his/her hands and/or skin hurt by the dusts, and dirt carried therein.

Taiwan Patent No. M338634 discloses a dewatering apparatus for providing a solution to overcome the aforementioned dewatering difficulty. The dewatering apparatus includes a bucket, a rotary unit, a transmission unit, and a driving rod unit. In operation, a mop cloth of a rotating plate type mop is disposed in a container of the rotary unit. The driving rod unit drives the transmission unit and the transmission unit drives the rotary unit, so as to dewater the cloth disposed in the container.

Although the dewatering apparatus mentioned above can dewater the mop cloth of the rotating plate type mop, the transmission unit uses gears for transmission. Therefore, the dewatering apparatus has the following disadvantages.

First of all, when the driving rod unit is applied by a force, the structure of the dewatering apparatus appears insufficient stability problems of displacement and jumpiness. The driving rod unit includes a driving rod. An upper end of the driving rod is pivotally connected with a shaft rod. The driving rod is adapted for driving the transmission unit by applying a leftward pivot force relative to the shaft rod. When the driving rod applies a leftward pivot force, the whole structure of the dewatering apparatus will be leftward moved. When the repetitive forces are applied thereon, the whole structure will then be driven to appear intermittent, leftward jumping displacements, and thus be difficult to be maintained at the original position. This may cause the driving rod of the driving rod unit unable to stably work or apply forces to and fro.

Secondly, it appears transmission non-smooth, acceleration difficult, and an insufficient centrifugal force. The mop cloth of the rotary disk type mop is dewatered by the centrifugal force of the rotary unit. As such, only when the container is accelerated to a certain rotation speed, the centrifugal force of the rotary unit can be provided to sufficiently dewater the mop cloth. However, the driving rod of the driving rod unit is incapable of stably working or applying forces to and fro, so that it is difficult to smoothly drive the gear rack to horizontally move so as to drive an in-line gear and a one-way gear. As such, it is hard to further improve the rotation speed of the rotary unit driven by the transmission unit.

Thirdly, because the whole structure of the dewatering apparatus intermittently and leftward jumpily displaces, the mop cloth of the rotary disk type mop cannot be stably positioned at a center of the container of the rotary unit. Therefore, the container may be caused with vibration, which deters the rotation.

Fourthly, a bottom of the receptacle body is provided with wheels. Although it is convenient for moving, the wheels unfortunately make the whole structure more unstable when applied with the leftward force by the driving rod.

In view of the aforementioned disadvantages of the dewatering apparatus disclosed by Taiwanese Patent No. M338634, it can be learnt that when dewatering by the centrifugal force, the whole structure must be maintained stable and the transmission should be smooth, so that the rotary unit should be stably accelerated to a certain rotation speed.

SUMMARY OF THE INVENTION

A primary objective of the present invention is to provide an electricity-free dewatering structure adapted for dewatering a water-contained object. The dewatering structure is adapted for dewatering a cloth sheet or various kinds of mop cloths. The dewatering structure also provides a solution to the problems of the aforementioned conventional dewatering structure.

In order to achieve the foregoing objective, a dewatering structure according to the present invention includes a receptacle body, a dewatering unit, and an operation apparatus. The receptacle body includes a receptacle tub and an assembling space, in which the receptacle tub and the assembling space are independent from each other. The dewatering unit is assembled in the receptacle tub. The operation apparatus is received in the assembling space, and includes an operation unit, and a base. The operation unit includes an active pedal, a driven pedal, and a driving block. The active pedal and the driven pedal are pivotally coupled to the base and are intersected with each other. The driven pedal includes a free end slidably coupled with the driving block. The driving block is configured with a threaded through hole axially penetrating through the driving block. The threaded through hole is provided for connection with a threaded rod which is sheathed in a spring member. In operation, the active pedal and the driven pedal are repetitively pressed each other and then released, so as to drive the driving block to linearly move to and fro along its axis. In such a way, the dewatering unit is driven to rotate, so as to produce a centrifugal force for removing water from the wet object.

Therefore, the dewatering structure of the present invention provides an improved alternative transmission approach. When using the dewatering structure of the present invention, the user can dewater the water-contained object by conveniently applying a force on the active pedal and releasing the force. When the operation is repeated, the driven pedal drives the driving block having the threaded through hole, and correspondingly the threaded rod is driven to rotate by the linear movement of the driving block along the axis of the driving block. In such a way, the threaded rod drives the dewatering unit to continuously rotate or rotate with an acceleration rate. As such, the dewatering structure is stabilized, in its entirety, at where it is. When such a dewatering structure is repetitively applied with external forces, it won't jump, be moved, or even fall down. Moreover, the dewatering structure according to the present invention has fewer components than the conventional dewatering apparatus does. Thus, assembling is easier and manufacturing is cheaper.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

The accompanying drawings are included to provide a further understanding of the invention, and are incorporated in and constitute a part of this specification. The drawings illustrate an embodiment of the invention and, together with the description, serve to explain the principles of the invention.

Figure 1:
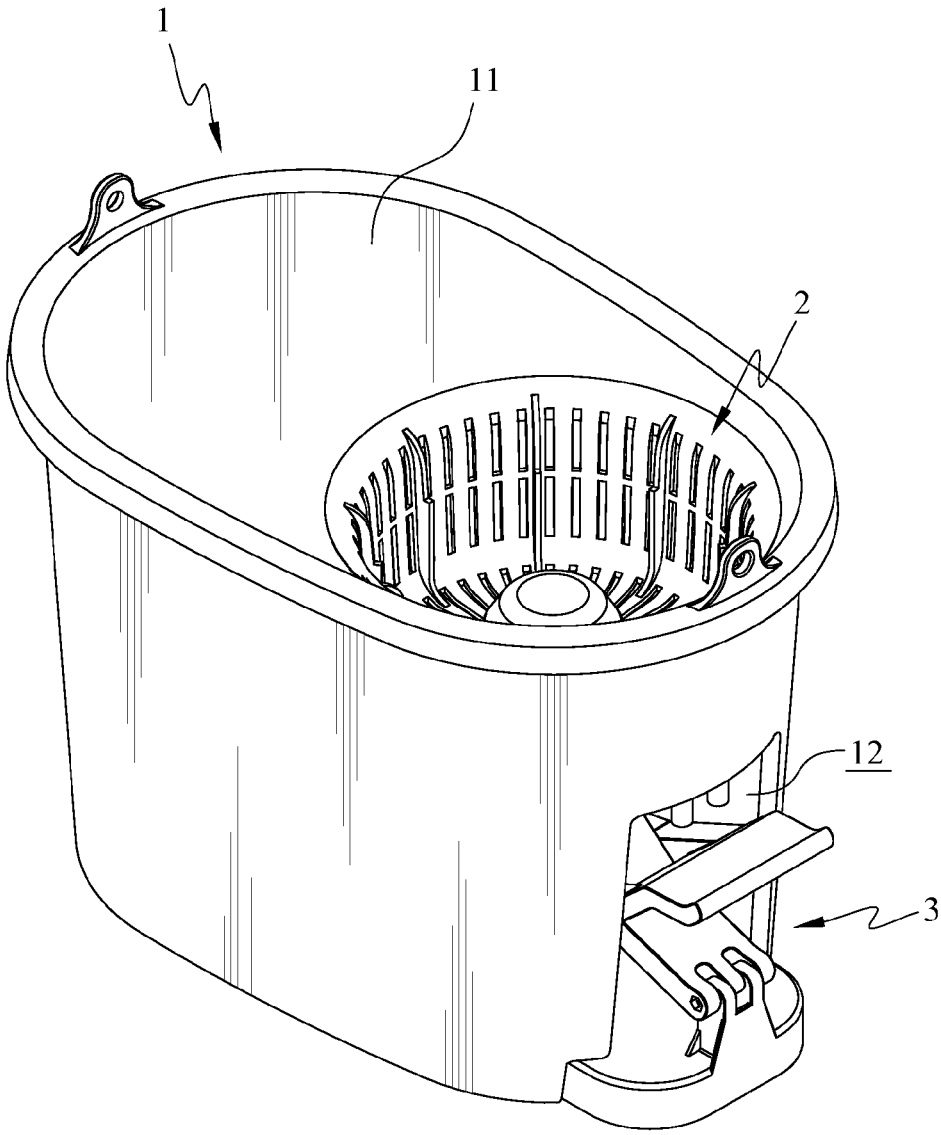
FIG. 1 is an perspective view showing a dewatering structure for dewatering a water-contained object according to an embodiment of the present invention.
Figure 2:
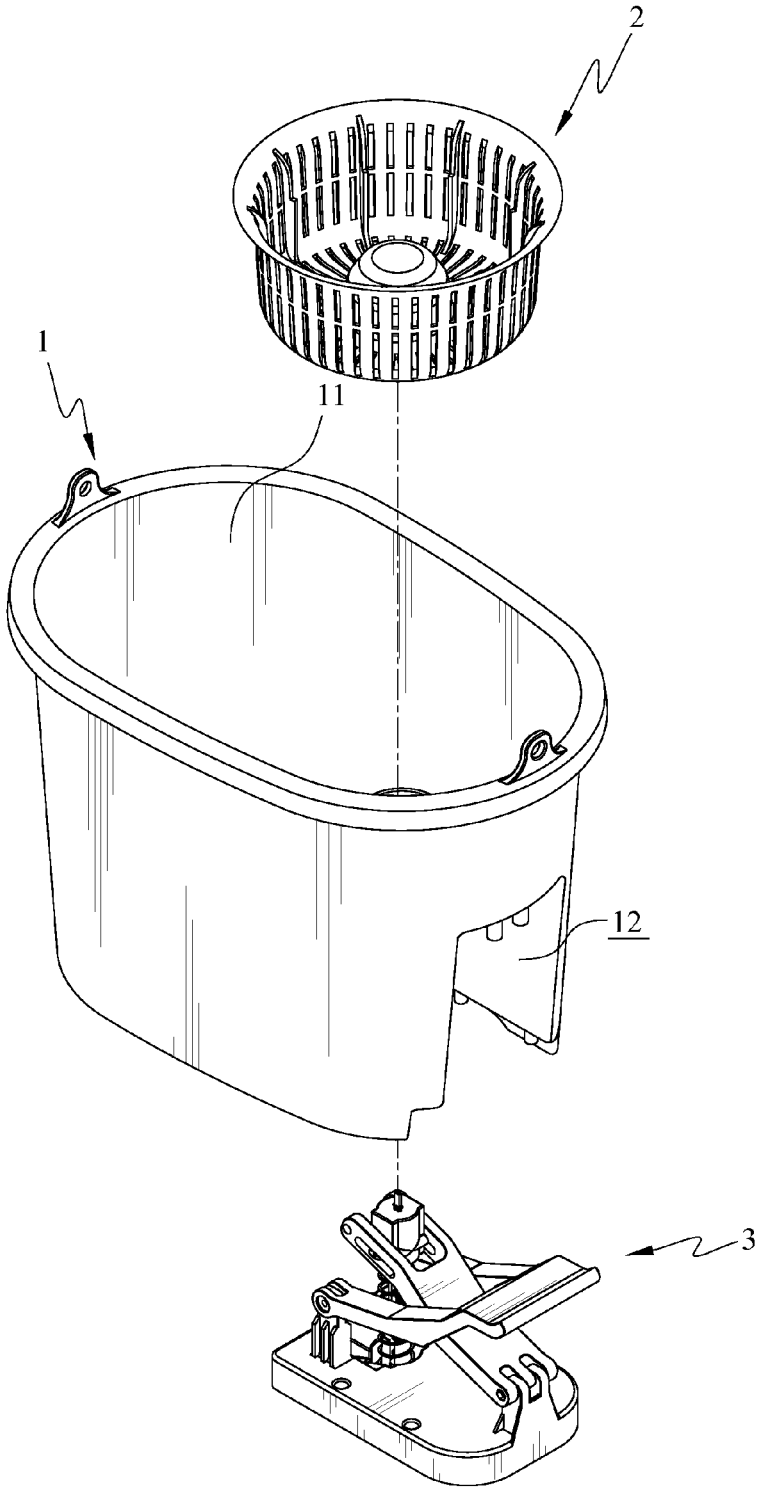
FIG. 2 is an explosive view showing the dewatering structure for dewatering a water-contained object according to the present invention.
Figure 3:
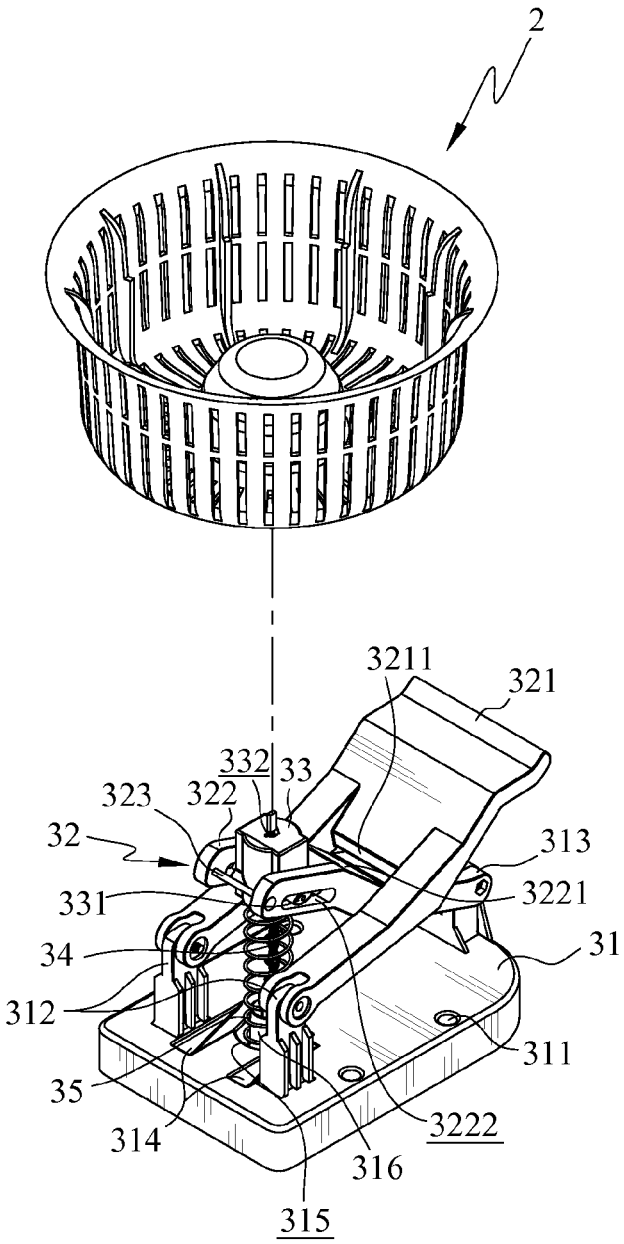
FIG. 3 is a detailed explosive view showing the dewatering structure for dewatering a water-contained object, in which a receptacle body is not shown.

Referring to FIGS. 1 to 3, a dewatering structure for dewatering a water-contained object according to the present invention includes a receptacle body 1, a dewatering unit 2, and an operation apparatus 3. The dewatering unit 2 and the operation apparatus 3 are assembled with the receptacle body 1.

Figure 4:
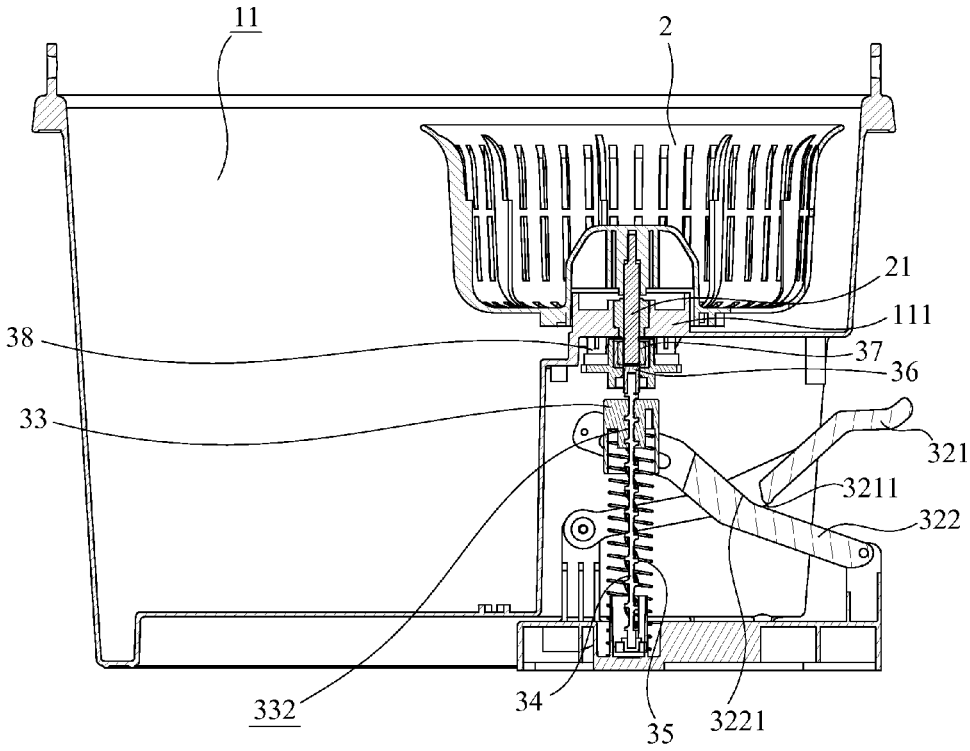
FIG. 4 shows a non-operation status of the dewatering structure for dewatering a water-contained object.

The receptacle body 1 is substantially configured with a hollow elliptical column shape, and includes a receptacle tub 11 and an assembling space 12. The receptacle tub 11 and the assembling space 12 are independently partitioned by a water proof material. The receptacle tub 11 is provided with a first fixing block 111, as shown in FIG. 4. The receptacle tub 11 is adapted for containing a fluid. Typically, the fluid can be water or a water solution. The assembling space 12 is defined beneath the receptacle tub 11.

The dewatering unit 2 is a bucket having a plurality of through holes allowing fluid to flow therethrough. A pole 21 is provided at a barycenter of a bottom of the receptacle tub 11 as shown in FIG. 4. The pole 21 is inserted into a center of the first fixing block 111, for assembling the dewatering unit 2 inside the receptacle tub 11.

The operation apparatus 3 is assembled inside the assembling space 12. The operation apparatus 3 includes a base 31 and an operation unit 32. The base 31 is substantially a rectangular block. Each corner of the base 31 includes a fixing hole 311 to fix the base 31 with the receptacle body 1. The operation unit 32 includes an active pedal 321 and a driven pedal 322. The active pedal 321 and the driven pedal 322 are both configured with a U shape. The active pedal 321 is wider than the driven pedal 322. The base 31 includes a pair of active pedal pivotal connecting portions 312, and a pair of driven pedal pivotal connecting portions 313. The pair of the active pedal pivotal connecting portions 312 and the pair of the driven pedal pivotal connecting portions 313 are respectively configured at two lateral sides of the base 31. The active pedal pivotal connecting portions 312 and the driven pedal pivotal connecting portions 313 are respectively positioned on the base 31 corresponding to width of the active pedal 321 and the driven pedal 322.

One end of the active pedal 321 is pivotally coupled to the active pedal pivotal connecting portions 312. The active pedal 321 includes an incline pressing surface 3211. One end of the driven pedal 322 is pivotally coupled to the driven pedal pivotal connecting portions 313. The driven pedal 322 includes an incline guiding surface 3221 corresponding to the pressing surface 3211. In this manner, the active pedal 321 and the driven pedal 322 are assembled to be intersected with each other, and positioned in correspondence to each other. Further, a free end of the driven pedal 322 is configured with two symmetric sliding slots 3222.

The base 31 further includes two symmetric downhill ramps 314 corresponding to the free end of the driven pedal 322. An accommodating space 315 is defined between the two downhill ramps 314, and an annular baffle 316 is disposed in the accommodating space 315.

The operation apparatus 3 further includes a driving block 33, which includes two flat wings 331 laterally protruded from two sides of the driving block 33. Preferably the two flat wings 331 are symmetric and arcuate shaped. The two flat wings 331 of the driving block 33 are respectively coupled inside the two symmetric sliding slots 3222. The driving block 33 further includes a threaded through hole 332 axially penetrating through a center of the driving block 33.

The operation apparatus 3 further includes a threaded rod 34 and a spring member 35. The threaded rod 34 is sheathed in the spring member 35. The threaded rod 34 has one end assembled through the threaded through hole 332 of the driving block 33 and another end positioned within the range of the annular baffle 316. One end of the spring member 35 is pressed beneath a bottom of the driving block 33, and another end of the spring member 35 is sheathed over an outer wall of the annular baffle 316. The operation unit 32 further includes a positioning bar 323 horizontally latched in the free end of the driven pedal 322 for restricting lateral movement of the driving block 33.

Referring to FIG. 4, the operation apparatus 3 further includes a rotary member 36. One end of the rotary member 36 is coupled with one end of the threaded rod 34, and another end of the rotary member 36 receives a unilateral bearing 37. The unilateral bearing 37 has a center portion, and the pole 21 of the dewatering unit 2 is adapted for inserting in the center portion of the unilateral bearing 37. The operation apparatus 3 further includes a second fixing block 38, and the rotary member 36 is disposed in a center portion of the second fixing block 38, so that the rotary member 36 can drive the unilateral bearing 37 to rotate relative to the second fixing block 38. The second fixing block 38 is secured at a top of the assembling space 12 corresponding to the first fixing block 111.

As shown in FIG. 4, the dewatering structure is shown as not in operation. In this case, the driving block 33 is supported by the spring member 35, and located at a high position. The driven pedal 322 is pulled by the two flat wings 331 of the driving block 33, and therefore the free end of the driven pedal 322 is also raised up. The pressing surface 3211 of the active pedal 321 is in contact with the guiding surface 3221 of the driven pedal 322, and therefore the free end of the active pedal is also located at a high position.

Figure 5:
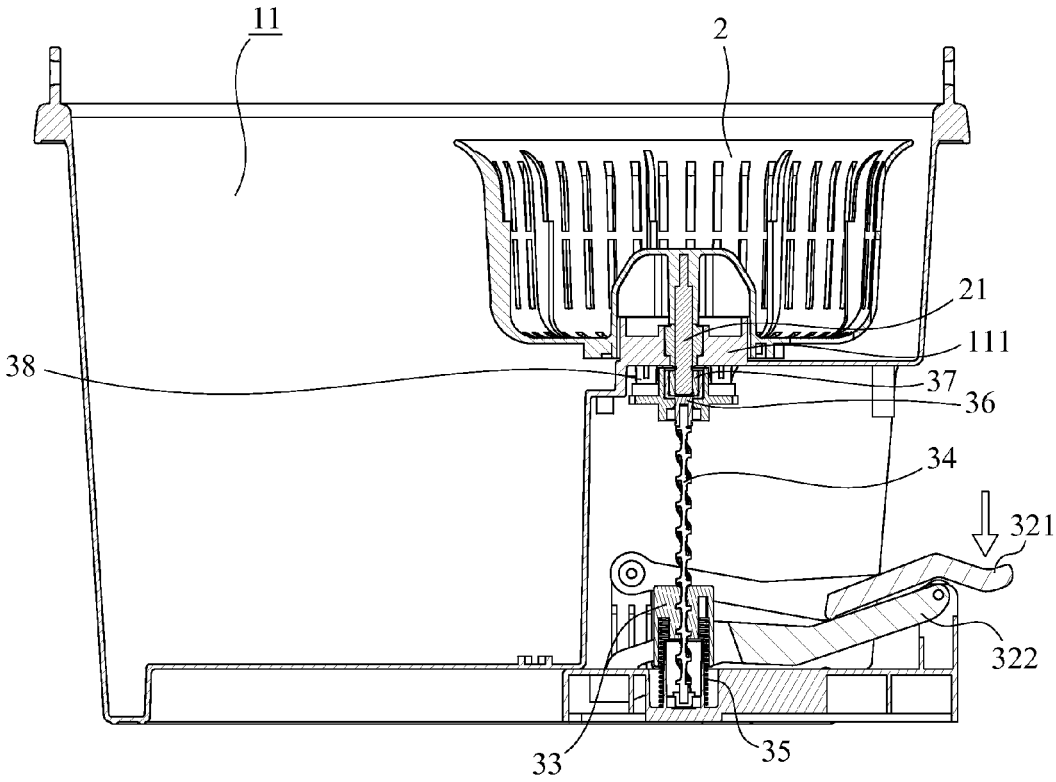
FIG. 5 shows an operation status of the dewatering structure for dewatering a water-contained object.

Referring to FIG. 5, when a user applies a force on the active pedal 321, the active pedal 321 is pressed down, during which the pressing surface 3211 moves along the slope of the guiding surface 3221 of the driven pedal 322. In such a way, the free end of the driven pedal 322 is moved downward to the downhill ramps 314. In this case, the two flat wings 331 of the driving block 33 gradually move from a higher end of the sliding slots 3222 to a lower end of the sliding slots 3222, and meanwhile the driving block 33 moves downward along an axial direction thereof so as to compress the spring member 35 and reserve a recovery force therein. The threaded rod 34 is then guided by the threaded through hole 332 of the driving block 33 to rotate. The threaded rod 34 then further drives the rotary member 36 and the unilateral bearing 37 to rotate. Correspondingly, the pole 21 and the dewatering apparatus 2 are synchronously rotated and produce a centrifugal force. Such a centrifugal force is adapted for removing water contained in the water-contained object disposed in the dewatering unit 2. The water removed from the dewatering unit 2 falls down in the receptacle tub 11.

When the force applied on the active pedal 321 is relieved, the recovery force reserved in the spring member 35 drives the driving block 33 to move toward an opposite direction. In this case, the two flat wings 331 of the driving block 33 are positioned at the high position of the sliding slot 3222. In this recovery process, the threaded rod 34 and the rotary member 36 are together guided by the threaded through hole 332 of the driving member 33 to reversely rotate. However, in this case, restricted by the unilateral bearing 37 which is irreversible, the pole 21 is not reversely rotated during the recovery process. Instead, it is slowed down to stop along with the inertia of the rotation.

In operation, applying the force on the active pedal 321 and then releasing the force may be repeated for several times for more sufficiently dewatering the water-contained object in the dewatering unit 2.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A dewatering structure for dewatering a water-contained object, comprising:

a receptacle body comprising a receptacle tub and an assembling space, wherein the receptacle tub and the assembling space are independent from each other;

a bucket-shaped dewatering unit having a plurality of through holes allowing fluid to flow therethrough, and disposed in the receptacle tub; and an operation apparatus comprising:

a base;

an operation unit including an active pedal and a driven pedal, wherein the active pedal and the driven pedal are pivotally coupled to the base and are intersected with each other, and the driven pedal comprises a free end; and a driving block having a threaded through hole axially penetrating therethrough, wherein the threaded through hole is adapted for engaged with a threaded rod which is sheathed in a spring member, wherein the free end of the driven pedal is slidably coupled with the driving block;

wherein when the active pedal and the driven pedal are repetitively pressed each other and then released, the driving block is driven to linearly move to and fro along its axis, so as to drive the dewatering unit to rotate, thus producing a centrifugal force for removing water away from the water-contained object.

2. The dewatering structure according to claim 1, wherein the active pedal and the driven pedal are both configured with a U shape, and the active pedal is wider than the driven pedal, and wherein the driven pedal comprises an incline guiding surface, and the active pedal comprises an incline pressing surface corresponding to the guiding surface of the driven pedal.

3. The dewatering structure according to claim 1, wherein the free end of the U shaped driven pedal is configured with two symmetric sliding slots, and the driving block comprises two wings slidably coupled with the two sliding slots.

4. The dewatering structure according to claim 1, wherein the operation apparatus further comprises a rotary member coupled with a unilateral bearing, and the rotary member has one end coupled to the threaded rod and another end coupled with the dewatering unit.

* * * * *